United States Patent [19]

Fuscaldo, Jr.

[11] Patent Number: 4,761,984

[45] Date of Patent: Aug. 9, 1988

[54] APPARATUS FOR SUPPORTING A VEHICLE FOR STRAIGHTENING AND ALIGNMENT

[76] Inventor: Frank Fuscaldo, Jr., 1635 Otlahurst Dr., Fairmont, W. Va. 26554

[21] Appl. No.: 912,059

[22] Filed: Sep. 26, 1986

[51] Int. Cl.[4] ..... B21D 1/12

[52] U.S. Cl. ..... 72/305; 72/705

[58] Field of Search ..... 72/705, 305; 187/8.41, 187/8.54

[56] References Cited

U.S. PATENT DOCUMENTS

| | | | |
|---|---|---|---|
| 3,583,203 | 6/1971 | Williams | 72/705 |
| 3,999,419 | 12/1976 | Larson et al. | 72/705 |
| 4,050,287 | 9/1977 | Borup | 72/705 |

OTHER PUBLICATIONS

Catalogue No. 164E, Nike Hydraulic Inc., Itasca, Ill., 60143, Sep., 1980.

*Primary Examiner*—Lowell A. Larson

[57] ABSTRACT

An apparatus for supporting a unibody vehicle for straightening and alignment purposes has a pair of crossbars clamped to the pinch welds on the underside of the vehicle body and at the ends of each crossbar there is affixed a vertical tower. Each vertical tower is pivotably connected to a wheel assembly and each vertical tower attached to a selected one of several heights with respect to the wheel assembly. A bench frame is positioned beneath the attached crossbars and attached thereto. The tilting of the crossbars on the wheel assembly and the vertical positioning of the crossbars with respect to the wheel assemblies facilitates loading of the vehicle onto the apparatus and enables the loaded vehicle to be positioned at a desired work height.

There is also disclosed a tower device which is movable independently of the apparatus for application of a force to a part of a vehicle supported on the apparatus.

17 Claims, 5 Drawing Sheets

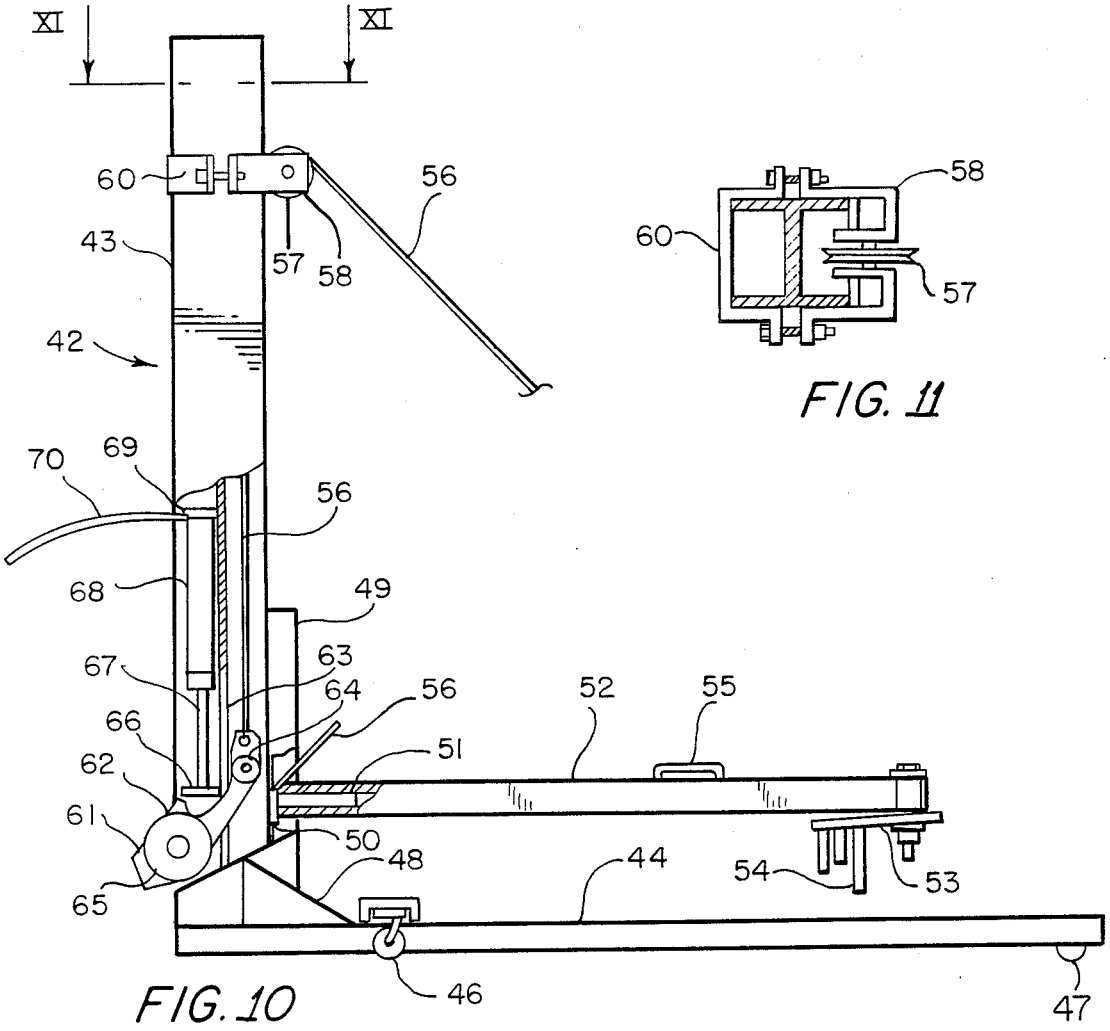
FIG. 10
FIG. 11
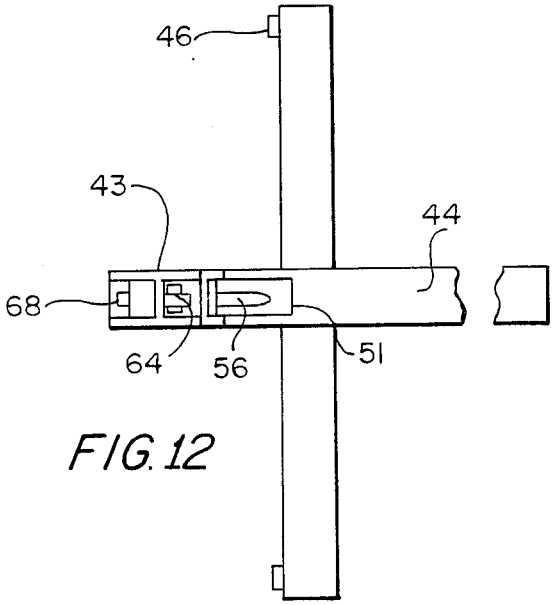
FIG. 12
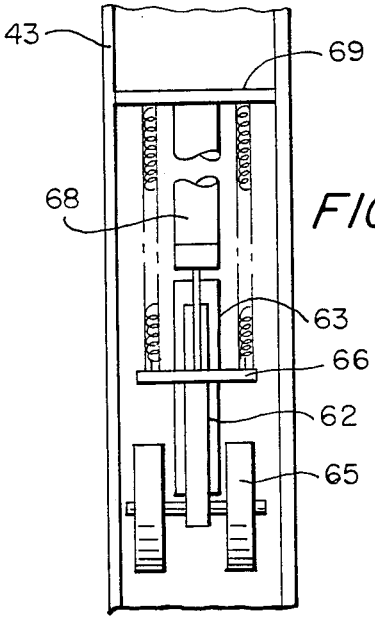
FIG. 13

APPARATUS FOR SUPPORTING A VEHICLE FOR STRAIGHTENING AND ALIGNMENT

BACKGROUND OF THE INVENTION

The present invention relates to the straightening and alignment of vehicle bodies and frames, more particularly, to an apparatus and method for rigidly supporting a unibody vehicle structure while carrying out alignment and straightening operations and other automotive repairs and services Many forms of apparatus have been proposed for the straightening and alignment of vehicle frames and bodies. One type of such apparatus comprises a frame structure which is attached to the underside of the vehicle to the frame by individual clamping means. In most unibody vehicles, the clamps grip pinch welds which are along both sides of the vehicle body near the outer edge. After such a frame structure has been clamped to the vehicle, conventional force transmitting devices are attached on the frame structure at various attachment points so that the body can be pulled or pushed into its original shape.

The straightening and alignment of car bodies having a frame is relatively easy since the straightening structures can be attached directly to the frame which is much stronger than the remaining structure of the vehicle body. However, in unitized bodies, also referred to as unibody structures, this is not possible because there is no frame and the various attachment points on the vehicle are generally no stronger than the portion of the body that has been collapsed.

Since considerable effort and time on the part of skilled personnel has generally been required to move the damaged vehicle body onto such a frame or to position a frame structure underneath the vehicle, efforts have been made to simplify such frame structures to facilitate loading or mounting of the vehicle thereon. In one such frame structure a pair of transverse crossbars having clamping means thereon are clamped to the underside of a vehicle body, such as by attaching the clamps to the pinch welds. A second frame structure which may merely comprise a pair of longitudinal beams is then rolled under the crossbars and attached to the crossbars. Suitable force transmitting devices are then attached to the resulting frame structure for use in straightening and aligning the vehicle body. Such frame structures are generally mounted on rollers or wheels so as to impart a degree of mobility to the frame structure even with a vehicle loaded thereon.

The loading of a vehicle on such a frame structure still requires a considerable amount of time and skill on the part of the loading personnel. Difficulties are generally encountered in positioning the cross bars properly underneath the vehicle body because of damage to the vehicle. It is then necessary for the personnel to position and reposition with a high degree of accuracy the crossbars in order that the pinch welds may be precisely clamped to the cross bars. Not only does such an operation require skill, but there is a certain amount of danger involved to the loading personnel because of the necessity for accurately positioning the crossbar beneath the vehicle body before clamping can be achieved.

Once the vehicle has been mounted on such a frame structure, the vehicle remains at a fixed height above the supporting surface upon which the frame structure rests.

This height may be varied by jacking up the frame structure with the attached vehicle and positioning stands to support the frame structure. However, such an operation is not satisfactory because of the time involved and the lack of flexibility in subsequently modifying the working height of the vehicle or in positioning the vehicle to some other location in the shop. Such prior art frame structures comprise a number of individual components which are susceptible to being misplaced and therefore not readily available when desired to carry out a particular aspect of loading of the vehicle.

SUMMARY OF THE INVENTION

There is thus a constant demand within the automobile repair industry to provide an improved apparatus for mounting of a vehicle for straightening and alignment purposes. It is particularly desirable that such an apparatus require a minimum of time in loading of the vehicle and that such a loading operation be carried out with maximum safety to all personnel concerned. It would further be desirable that such a frame be a complete unit which would not require any additional individual components either when loading of the vehicle or during carrying out of the actual straightening, alignment or other servicing operations.

It is therefore the principal object of the present invention to provide a novel and improved apparatus and method for supporting a vehicle body for straightening and alignment and other automotive repairs.

It is another object of the present invention to provide such an apparatus which is particularly adapted for supporting a unibody vehicle structure having pinch welds on the underside of the vehicle body.

It is a further object of the present invention to provide such an apparatus which greatly facilitates the loading of a vehicle thereon and requires a minimum of time on the part of the loading personnel while maintaining high safety standards.

It is an additional object of the present invention to provide such an apparatus which can be readily and quickly adjusted to a desired work height of the vehicle and which is portable to allow a vehicle loaded thereon to be moved to desired work positions or to different locations.

It is still another object of the present invention to provide such an apparatus which can function as a work or storage stand for a vehicle without the necessity for detaching and reattaching the entire frame structure to the vehicle body.

It is still a further object of the present invention to provide such an apparatus to allow utilization of main frame, wheel assemblies, straightening equipment, measuring devices, and other equipment on other vehicles while time consuming work is performed on initial vehicle or various delays impede work progress on the initial vehicle. This may be accomplished by duplicating only the crossbar assemblies for each additional vehicle. The crossbar assembly is only a small portion of the apparatus as a whole.

It is yet another object of the present invention to provide a novel and improved device which is movable independently of the apparatus of the present invention for application of a force to a structural part of a vehicle supported on the apparatus in order to restore this part to a predetermined configuration.

According to one aspect of the present invention, an apparatus for supporting a vehicle structure may comprise a pair of crossbars clamped to the underside of a vehicle body in horizontal spaced parallel relationship transverse to the longitudinal axis of the vehicle body. A bench frame is detachably attached to the undersides of the crossbars. Each crossbar has a pair of vertical towers fixedly attached to its ends and a roller or wheel assembly is pivotably connected to each of the vertical towers to permit vertical adjusting of the towers with respect to the wheel assemblies.

A method for mounting the vehicle structure upon a frame apparatus for straightening and alignment purposes may comprise the steps of securing a pair of crossbars to the underside of the vehicle body in horizontal spaced parallel relationship transverse to the longitudinal axis of the vehicle body. The secured crossbars are then raised to the desired work height of the vehicle body. Roller or wheel means are then adjustably attached to the crossbar to support the vehicle structure at the selected work height.

BRIEF DESCRIPTION OF THE DRAWINGS

Other objects and advantages of the present invention will be apparent upon reference to the accompanying description when taken in conjunction with the following drawings, which are exemplary, wherein;

FIG. 10 is a side elevational view of the movable tower device for applying a force to a part of a vehicle with portions of the vertical member and attaching arm being removed to show details of construction;

FIG. 11 is a sectional view taken along the line XI—XI and in enlarged scale to show details of construction of the adjustable pulley;

FIG. 12 is a top plan view of the tower device of FIG. 10;

FIG. 13 is a rear elevational view of a portion of the vertical member of the tower in enlarged scale to show details of the mounting of the hydraulic cylinder and wheeled trolley.

DETAILED DESCRIPTION OF THE PREFERRED EMBODIMENTS

Proceeding next to the drawings, wherein like reference symbols indicate the same parts throughout the various views, a specific embodiment and modifications of the present invention will be described in detail.

Figure 1:
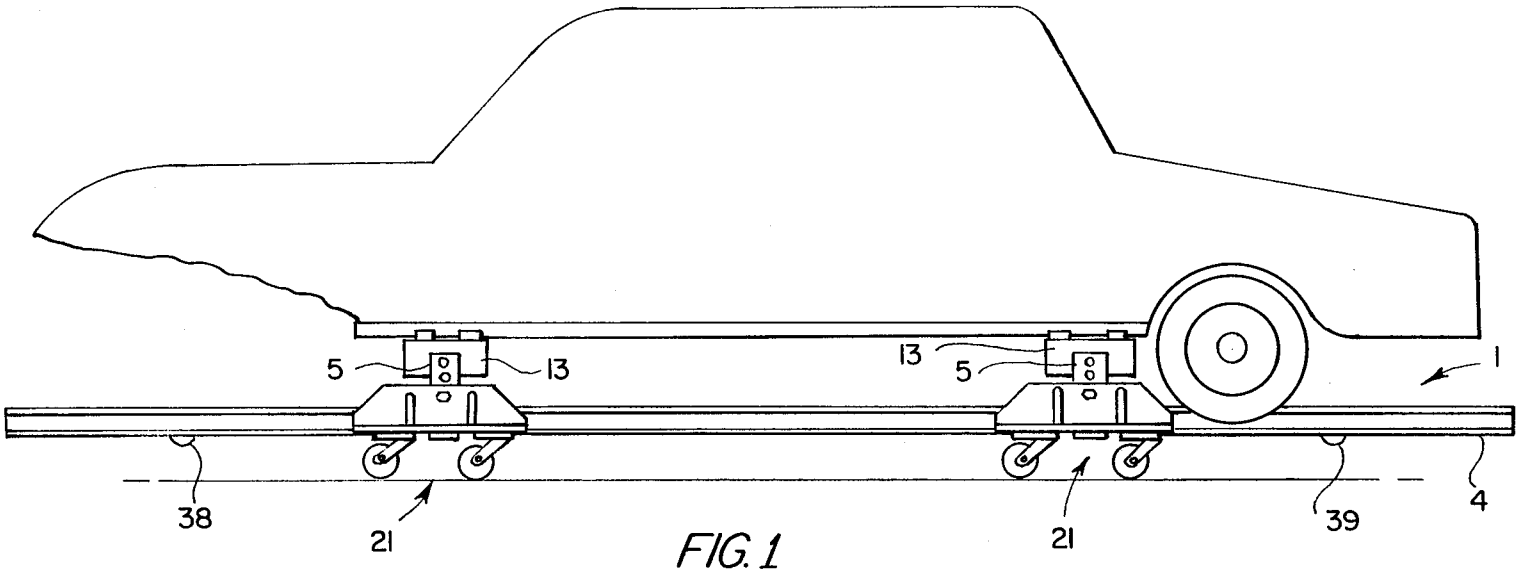
FIG. 1 is a side elevational view of the apparatus according to the present invention with a vehicle body mounted thereon.
Figure 2:
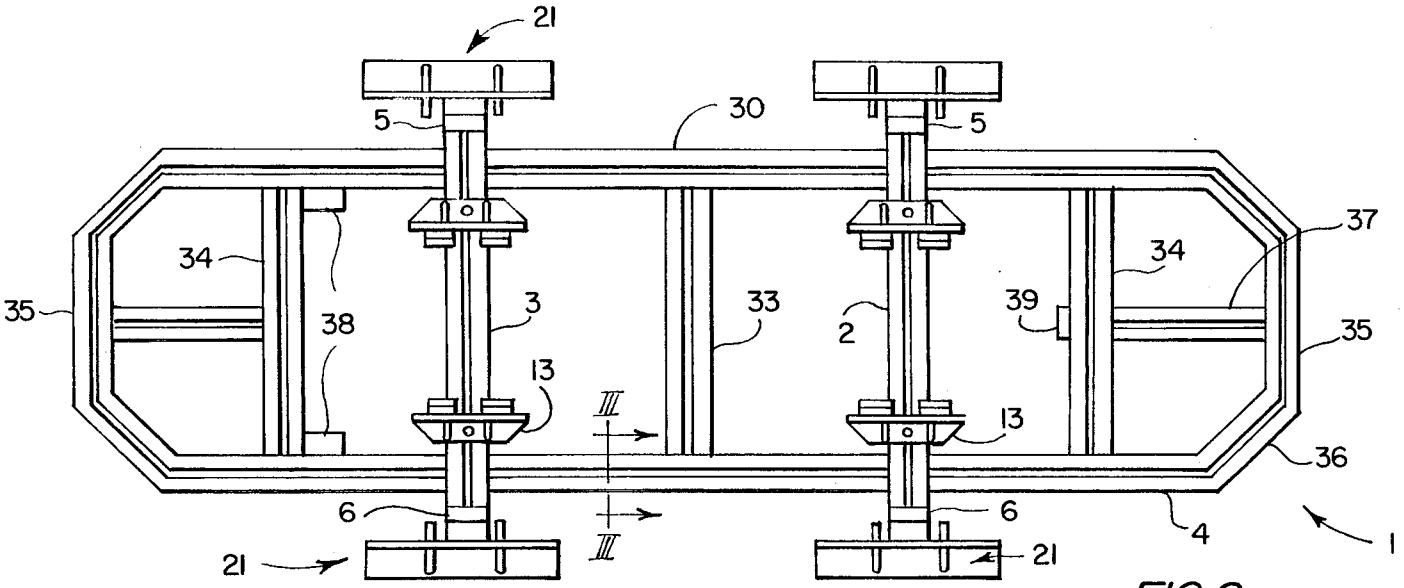
FIG. 2 is a top plan view of the vehicle supporting apparatus of FIG,. 1.
Figure 4:
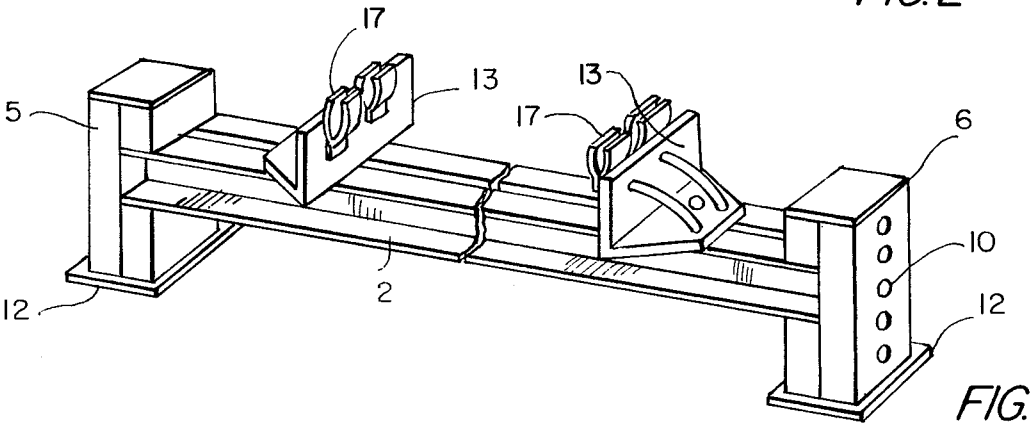
FIG. 4 is a perspective view of the crossbar with attached clamping brackets according to the present invention.

With reference to FIGS. 1 and 2, an apparatus for supporting a vehicle structure for straightening and alignment purposes is indicated generally at 1 and comprises a pair of crossbars 2 and 3 and a bench frame 4 attached to the undersides of the crossbars. Each of the crossbars 2 and 3 is formed from a pair of channel beams positioned in back to back relationship and spaced from each other to define a gap there between as shown in FIG. 7. At each end of the crossbeam are vertical towers 5 and 6. Each of these vertical towers is formed from an outer tubular member having a rectangular cross section 7 and extending both above and below the cross member as may be seen in FIGS. 4 and 6. Each tower also comprises a pair of inner tubular members 8 and 9 of the same configuration as the outer tubular member 7 and securely fastened to the innerface of the outer tubular member and positioned above and below the cross member 2 as again may be seen in FIG. 6. Each vertical tower has a plurality of vertically spaced horizontal bores 10 there through and in this particular embodiment there are five such bores. The center bore passes only through the outer tubular member as may be seen in FIG. 6 and the remaining bores pass through both the inner and outer tubular members.

The top of each tower is covered with a top plate 11 and at the bottom of each tower is a base plate 12 which is of sufficient thickness so as to provide a rigid and firm support for the crossbar even when a vehicle is supported thereon.

Figure 6:
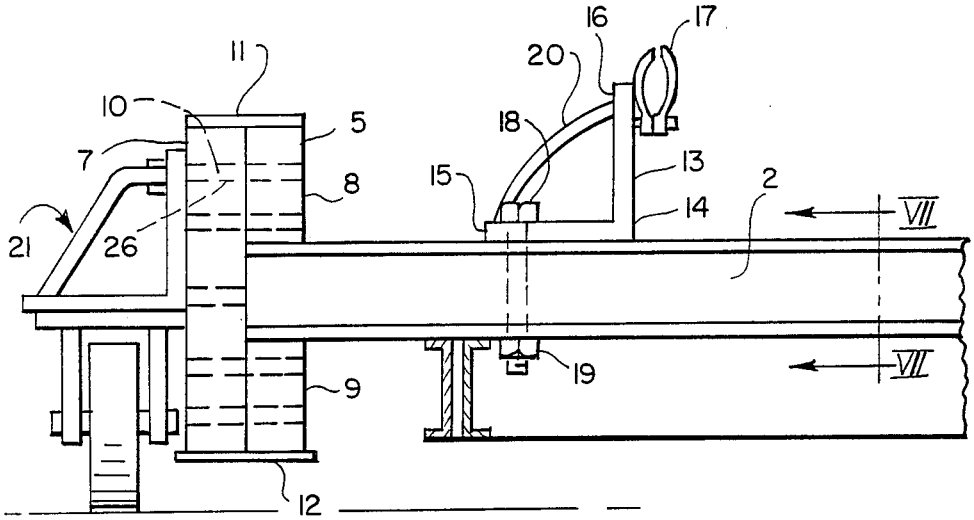
FIG. 6 is a front elevational view of approximately one-half the crossbar assembly seen in FIG. 5.
Figure 7:
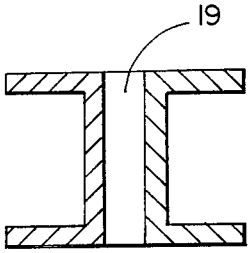
FIG. 7 is a sectional view taken along the line VII—VII of FIG. 6.

Slidably positioned on the upper surface of crossbar 2 is a pair of clamping brackets only one of which 13 is shown in FIG. 6. The clamping brackets 13 comprises an angle member 14 having a horizontal flange 15 and a vertical flange 16. A pair of clamps 17 as known in the art are attached to the vertical flange such as by bolts or other suitable fastening elements. A single bolt 18 extends downwardly from horizontal flange 15 to pass through slot 19 formed between the two channel members of the crossbar 2. The bolt is then secured to the crossbar by means of a nut 19 in the usual manner.

Figure 5:
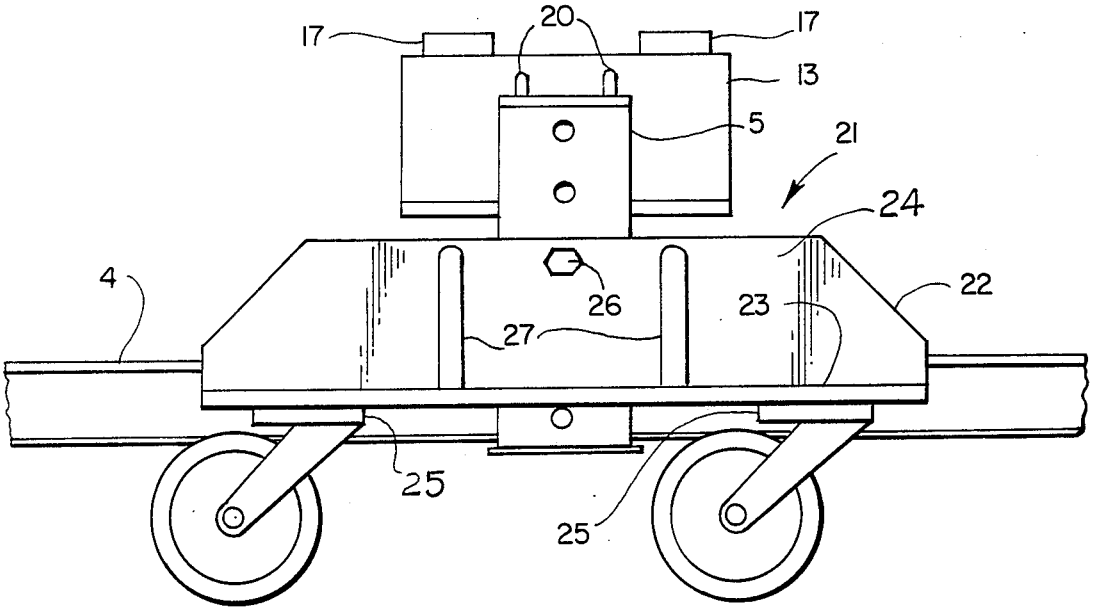
FIG. 5 is a side elevational view but in larger scale of the crossbar assembly including the clamping bracket, crossbar and wheel assembly, as seen in FIG. 1.
Figure 8:
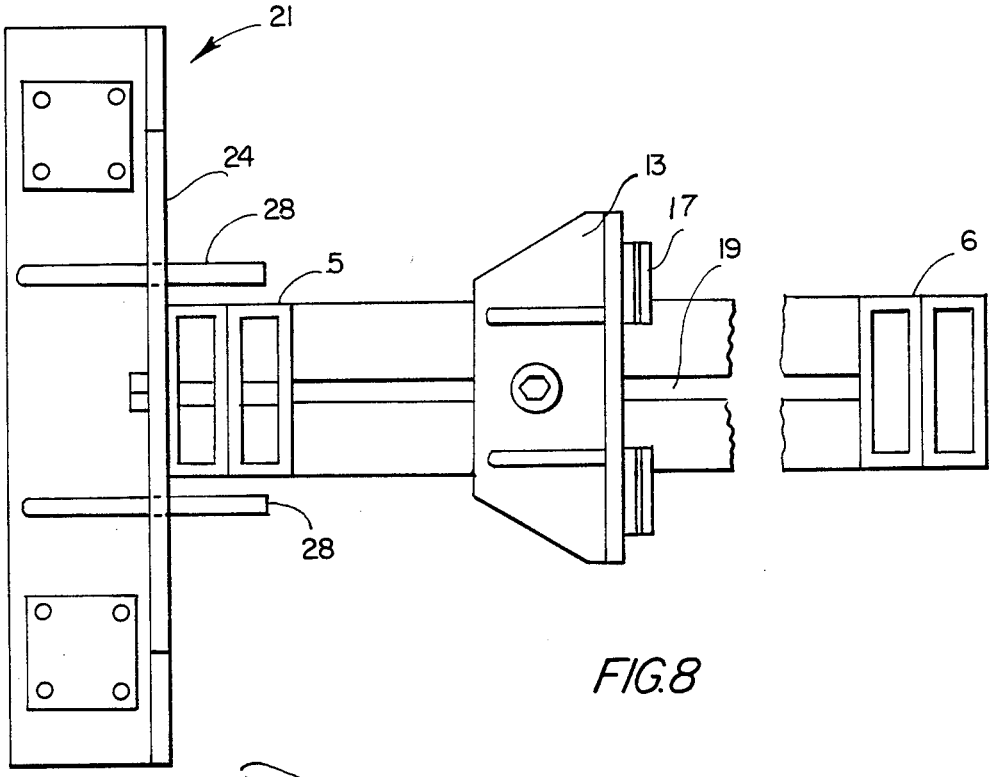
FIG. 8 is a top plane view of the crossbar assembly shown in FIG. 6 with the top plates removed from each of the towers to show structural details thereof.

In order to facilitate movement of the clamping brackets along the crossbar, a pair of handles 20 are provided which are rod like elements extending between the vertical and horizontal flanges 15 and 16 and spaced a distance which is slightly less than the width of the crossbeam as may be seen in FIGS. 5 and 8.

Each tower 5 and 6 of cross bar 2 is pivotably connected to a wheel or roller assembly indicated generally at 21 and shown in greater detail in FIGS. 5, 6, 8 and 9. The wheel assembly is formed of an angle member 22 having a horizontal flange 23 and a vertical flange 24. Attached to the underside of horizontal flange 23 adjacent the ends thereof are pivotable castors 25 so as to facilitate change of direction of the wheel assembly. Extending horizontally from the upper portion of vertical flange 24 and permanently affixed in position is a pivot pin 26 which is selected so as to have a diameter to be loosely received within the opening 10 of the vertical tower 5. The wheel assembly is also provided with handles 27 which extend between the horizontal and vertical flanges 23 and 24 as may be seen in the drawings. Extending inwardly from the innerface of vertical flange 24 is a pair of rods 28 which may actually constitute extensions of the handles 27. These handles 27 and rods 28 are spaced on either side of tower 5 and function to limit the pivoting of the vertical tower 5 with respect to the wheel assembly 21.

The wheel assembly 21 and vertical tower 5 are so dimensioned and the horizontal openings 10 are so spaced that when pivot pin 26 is inserted into the uppermost of the openings 10 the base 12 of tower 5 will have a clearance above supporting surface 29 upon which the wheel assembly rests of approximately $\frac{1}{2}$-$\frac{7}{8}$ of an inch which is sufficient to permit movement of the crossbar and wheel assembly upon a surface. In this embodiment, each vertical tower has a height of approximately 15 inches.

Figure 3:
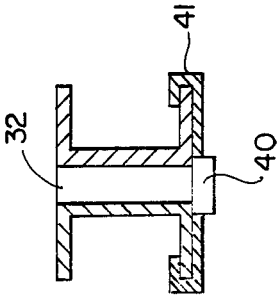
FIG. 3 is a sectional view taken along the line III—III of FIG. 2.

As may be best seen in FIG. 2, the bench frame 4 comprises a pair of parallel longitudinal members 30 and 31 each of which is formed by a pair of back to back channel beams separated by spacers to define a gap 32 there between as shown in FIG. 3. Connecting substantially the midpoints of the longitudinal members 31 and 30 is a transverse beam 33 and a pair of transverse beams 34, connect the end portions of the longitudinal members 30 and 31 inwardly of their ends as may be seen in FIG. 2. Outwardly of the ends of the longitudinal members 30 and 31 are end transverse members 35 the ends of which are connected to the ends of the longitudinal members 30 and 31 by connecting beams 36 disposed at substantially 45 degrees to the longitudinal beams 30 and 31 and to the end transverse beams 35. A pair of longitudinally extending mid-beams 37 interconnect the midpoints of the end beams 35 and transverse beams 34.

All of the transverse and connecting members of the bench frame are similarly formed of back to back channel members as shown in FIG. 3.

Adjacent one of the transverse beams 34 is a pair of five-inch castors 38 so mounted that only a portion of the wheel projects beyond the bottom of the longitudinal beams as may be seen in FIG. 1. Adjacent the other of the transverse members 34 is a single pivotable castor 39 which is similarly positioned. The positioning of bench-frame castors 38 and 39 is such that the bench frame can be rolled under the crossbars 2 and 3 when the vertical towers 5 and 6 are pivotally connected to wheel assemblies or are positioned on stands or platforms.

Slidably mounted on the bottom flanges of each of the longitudinal members 30 and 31 is a sliding nut 40 which is retained by bracket members 41 to the flanges of the channel members as shown in FIG. 3. The sliding nut 40 receives a bolt which is passed downwardly through the gap 19 in crossbar 2 or 3 in order to secure the bench frame to the crossbar. Each of the four intersections of the crossbars with the longitudinal members 30 and 31 of the bench frame are attached by means of such a bolt and sliding nut.

In order to mount the vehicle body, such as a unibody vehicle structure, upon the apparatus of the present invention, one end of the vehicle body is raised such as by use of a hydraulic jack found inmost garages and service shops.

Figure 9:
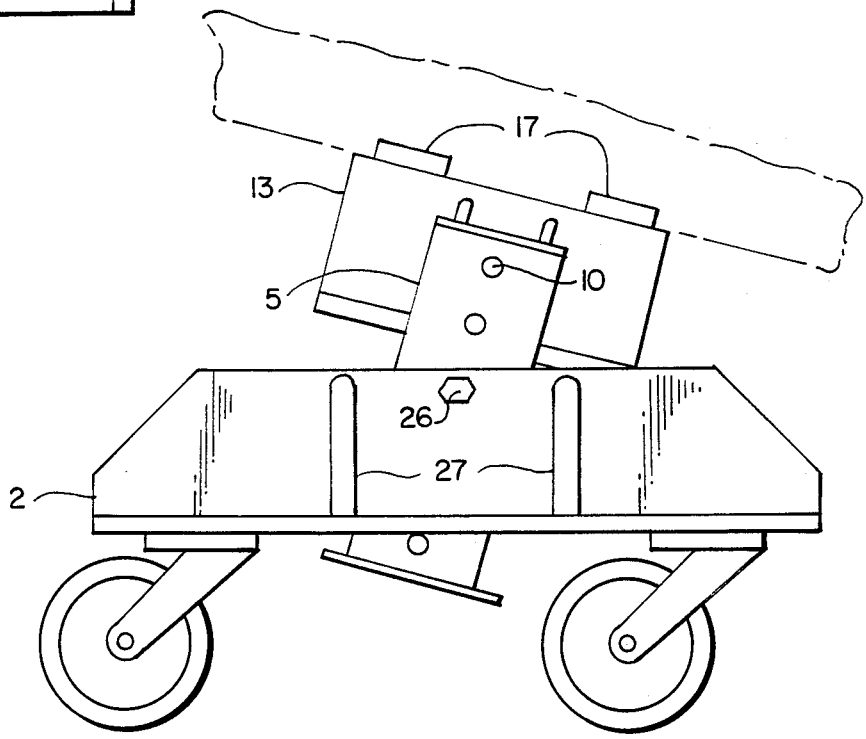
FIG. 9 is a side elevational view similar to that of FIG. 5 but showing the crossbar tilted with respect to its wheel assembly when the clamping bracket is being secured to a raised end of the vehicle.

A crossbar assembly 2 pivotably mounted to a pair of wheel wheel assemblies 21 as described above is then rolled underneath the raised end of the vehicle. The pivot connection between the pivot pin 26 on the wheel assemblies and the towers 5 and 6 enables the crossbar to be tilted to correspond to the angle of inclination of the vehicle as seen in FIG. 9.

The raised end of the vehicle is then lowered so that the pinch welds on the underside of the vehicle will be positioned into the four pinch weld clamps 17 in a manner as known in the art.

The clamps 17 are then fastened to securely attach the crossbar to the vehicle body.

The other end of the vehicle is then raised and in a similar manner crossbar 3 is rolled beneath the raised other end of the vehicle. If necessary, the crossbar 3 is also tilted on its pivot connection to the wheel assemblies so as to correspond to any angle of inclination of the vehicle body.

The raised other end of the car is then lowered into the four pinch weld clamps of the crossbar 3. The clamps are then fastened to securely attach the second crossbar assembly to the vehicle body.

The attached crossbar assemblies are each then raised to the desired work height of the vehicle. For example, if the upper portion of the car is to be worked upon, then the height of the vehicle is relatively low. However, if the side or lower portions of the vehicle body are to be worked upon it would then be desirable to have the vehicle body raised as high as possible. When the crossbar assemblies have been raised to the desired work height, the pivot pins of the wheel assemblies are then fitted into the corresponding tower openings to support the vehicle body at the desired work height. The pivot pin connection between the wheel assembly and tower of a crossbar enables the wheel assembly to be removed from the tower and then after the wheel assembly has been positioned upon the supporting surface, the pivot pin is then inserted into the proper tower opening.

The jacks at each end of the car are then released one at a time so that the vehicle body then rests at the desired work height on the four wheel assemblies.

The bench frame 4 is then rolled under the attached crossbars or the car with attached crossbars may be rolled over the bench frame. The bench frame is then raised by jacks and fastened to all four intersections with the crossbars by bolts passed down through the crossbars to be engaged with the sliding nuts on the bottom flanges of the longitudinal members as described above.

With the frame and crossbars in position as described above, suitable force transmitting devices may be then applied to different parts of the vehicle body to carry out the strengthening operation as known in the art.

If it is desired to temporarily suspend work on the vehicle body, the vehicle body as supported on the apparatus as shown in FIG. 1 can be moved to a desired location in the shop and the bench frame removed. The wheel assemblies can also be removed from the crossbars and the vehicle will remain attached to the crossbars which then rest upon the bases of the towers. The bench frame and wheel assemblies can then be used with another pair of crossbars to position a second vehicle body while the first vehicle body remains standing on the crossbars as just described. It should be noted that the vertical adjustment of the mounted vehicle body to a desired working height is carried out only with the tower and wheel assembly as described above and it is not necessary to use jack stands.

Based upon actual use of the apparatus according to this invention, the loading of a vehicle can be accomplished in about $\frac{1}{2}$hour or less compared to one or more hours required for loading a vehicle on prior art structures. The vehicle is easily and safely loaded with ordinary shop jack equipment with a maximum of safety to the operating personnel. The apparatus with a vehicle body loaded thereon is then easily and safely adjustable to a desired work height over a range of about 12 inches. In extreme cases, the highest adjustable height is possible under safe conditions.

The working heights of a loaded vehicle body may be changed to facilitate work on different parts of the vehicle body with ordinary shop jack equipment in only a few minutes' time.

The operator of a repair shop need only require an additional pair of crossbar assemblies so as to enable one car to remain loaded upon the crossbar assemblies while the entire apparatus can be used to load another car which might be worked upon in the meantime.

The structure of the bench frame provides an extremely rigid and strong structure and the beveled corners on the bench frame formed by the angle connecting beams provides an additional safety feature since it eliminates sharp corners which may cause injuries to personnel working in the vicinity of a vehicle body loaded on the apparatus.

The crossbars and the bench frame may also be constructed of tubular elements having rectangular or other suitable cross sections in place of the channel beams.

In addition to straightening of the vehicle, the vehicle mounted on the apparatus according to the present invention can then be aligned in a manner known in the art to the proper specifications as set forth by the manufacturer.

The invention can be used for all types of automotive repair such as body and frame work, mechanical work and finishing including painting.

One particular embodiment of a force transmitting or applying device which is preferably used with the apparatus of the present invention is shown in FIGS. 10–12. This device comprises a tower indicated generally 42 which is movable independently of the apparatus but is attachable to the bench frame of the apparatus. The tower 42 comprises a vertical member 43 which is in the form of an H-beam whose lower end is attached to the upper surface of a channel shape base member 44. A cross member 45 is attached to the upper surface of the base member 44 and is provided with castors 46 mounted at the outer ends thereof. The end of the base member 45 remote from the vertical member 43 is provided with a roller 47. A pair of triangular reinforcing members 48 also connect the lower end of the vertical member 43 with the top surface of the base member 44.

In order to attach the tower 42 to the apparatus of the present invention, there is provided a channel member 49 which is welded to the flanges on one side of the vertical member 43 and the inner sides of the flanges of the channel are provided with vertical grooves in which is slidably positioned a plate 50 to which is attached a horizontally extending mounting arm 51 which may be hollow in cross section. An attaching arm 52 which consists of a tubular member having a hollow cross section so as to receive the mounting arm 51 as shown. At the outer end of the attaching arm there is pivotally mounted a connecting plate 53 from the lower surface of which depends three pins 54 for connection with the bench frame. The pins 54 are positioned so as to be received within the groove 32 and adjacent the flanges of the channel members forming the bench frame. On the upper surface of the attaching arm 52 is provided a handle 55 to facilitate handling of the attaching arm. A rod 56 extends at an angle from the plate 50 to facilitate raising or lowering of the plate and mounting arm structure 50, 51.

Force is applied to a selected structural part of a vehicle by means of a cable or chain 56 as known in the art which passes over a pulley 57 which is vertically adjustable on the vertical member 43. The pulley 57 is journalled on a substantially U-shaped member 58 on the inner surfaces of which are mounted blocks which are inclined at an angle corresponding to the angle of taper of the upper portion of one side of the vertical member as indicated at 59. The U member 58 is attached to a second U member 60 by means of bolts passing through flanges as may be seen in FIGS. 10 and 11. Thus, the pulley 57 is adjustably positionable in a desired vertical position on the vertical member 43 and can be secured in position by means of a wedging action between a portion of the pulley mounting bracket and the tapered edges of the vertical member.

The cable or chain 56 extends downwardly between the flanges on one side of the vertical member and is coupled to the upper end of a wheeled trolley 61.

The trolley 61 comprises a central member 62 which passes through a vertical slot 63 formed in the web of the vertical member 43. The body member has a pair of wheels 64 which ride on one side of the web of the vertical member and a second pair of wheels 65 which ride on the other side of the web. As may be seen in the drawing, the wheels 65 are somewhat larger in diameter than the wheels 64. Mounted on the body member 62 is a horizontal plate member 66 which is acted upon by ram 67 of a hydraulic cylinder 68 the upper end of which is attached to a plate 69 firmly secured to the flanges and web of the vertical member 43 as shown in the drawing. A pair of return springs connect the plate 66 with the bracket 69 so that when the ram 67 is retracted or moved in the upward direction, the springs will return the wheeled trolley to an upper position within the slot 63. Extending from the upper end of the hydraulic cylinder 68 is a control line 70 which leads to suitable controls as known in the art.

In operation, the attaching arm 52 is first secured to the bench frame by means of the pins 54 and the tower 42 is then moved along its supporting surface such that the mounting arm 51 is inserted intothe attaching arm 52. The mounting arm 51 is manually adjusted to the correct height so as to be insertable into the attaching arm 52. The hydraulic ram is then retracted to its uppermost position and the cable or chain 56 attached to the structural part of the vehicle. When the ram exerts a power stroke, the wheel trolley 61 will be urged downwardly to pull the cable or chain 56 downwardly so as to apply a force to the part of the vehicle to which the cable or chain is attached.

When the tower is being moved into position, the base member 44 is moved under the bench frame which has been secured in a raised position as described above.

It will be understood that this invention is susceptible to modification in order to adapt it to different usages and conditions, and accordingly, it is desired to comprehend such modifications within this invention as may fall within the scope of the appended claims.

What is claimed is:

1. In an apparatus for supporting a vehicle structure for repair and finishing purposes, a pair of crossbars beneath a vehicle body in horizontal spaced parallel relationship transverse to the longitudingal axis of the vehicle body, each crossbar having two ends and a length greather than the width of the vehicle body, a pair of clamping means on each said crossbar for clamping said crossbars to pinch welds on the uderside of the vehicle body, a bench frame having a length substantially equal to that of the vehicle body and a width less than the length of the crossbars detachably attached to the undersides of said crossbars, a plurality of vertical towers each fixedly attached to an extremity of a said end of said crossbars and extending both above and below the respective crossbar, said towers each extending below said crossbar a sufficient distance to support the vehicle body upon a supporting surface such that the wheels of the vehicle are clear of the supporting surface.

2. In an apparatus as claimed in claim 1 and further comprising roller means pivotably connected to each of said towers for supporting said towers upon a supporting surface such that each tower is pivotable in a verticle plane with respect to its respective roller means.

3. In an apparatus as claimed in claim 2, and further comprising means for adjustably positioning said roller means vertically on a said tower to vary the vertical distance of the crossbar above a supporting surface.

4. In an apparatus as claimed in claim 2, wherein each of said towers has a plurality of vertically spaced horizontally disposed openings therein, said roller means having an upstanding portion, and a pivot pin extending horizontally from said upstanding portion and passing through a selected one of said tower openings to define a pivotable connection between said roller means and said tower.

5. In an apparatus as claimed in claim 4, wherein said tower openings are so positioned that when said pivot pinsis inserted into the uppermost opening, the bottom of said tower will be spaced from a supporting surface to enable the tower to be moved on said roller means upon said supporting surface.

6. In an apparatus as claimed in claim 4, and further comprising means on said upstanding portion engageable with said tower for limiting the pivoting movement between said tower and said roller means.

7. In an apparatus as claimed in claim 2, wherein said roller means each comprises an angle member having a horizontal flange and a vertical flange, a plurality of castors attached to the underside of said horizontal flange, and a horizontally extending pivot pin attached to said vertical flange and insertable in an opening in said tower to define a pivotable connection between said tower and said roller means.

8. In an apparatus as claimed in claim 7, and further comprising a pair of spaced handles extending between the horizontal and vertical flanges of each said roller means.

9. In an apparatus as claimed in claim 1, wherein each of said towers comprises a substantially rectangular hollow tubular member having a face abutting an end of said crossbar and extending above and below said crossbar, a pair of substantially rectangular inner tubular members each fastened to said abutting face of said outer tubular member above and below said crossbar, said inner tubular members having ends co-extensive with ends of said outer tubular member, and a base plate on the lower ends of said outer tubular member and the inner tubular member below said crossbar.

10. In an apparatus as claimed in claim 9, wherein there are a plurality of vertically spaced horizontally aligned bores passing through said outer and inner tubular members.

11. In an apparatus as claimed in claim 1, wherein said bench frame comprises a pair of parallel-spaced longitudinal beams, a first transverse beam interconnecting said longitudinal beams at the mid-portions thereof, a pair of second transverse beams interconnecting said longitudinal beams inwardly of the outer ends thereof, a pair of third transverse beams outwardly of the ends of said longitudinal beams and connecting beams disposed at substantially 45 degrees to said longitudinal beam and said third transverse beams interconnecting the ends of said third transverse beams to the ends of said longitudinal beams, and a pair of longitudinally extending midbeams interconnecting each of said third transverse beams to the corresponding second transverse beams.

12. In an apparatus for supporting a unibody vehicle structure for straightening and alignment, a crossbar assembly attachable to pinch welds on the underside of the vehicle body comprising a crossbar having two ends and a length greater than the width of the vehicle body and disposable beneath the vehicle body transverse to the longitudinal axis of the vehicle body, a pair of clamping means on said crossbar for clamping said crossbar to the pinch welds on the underside of the vehicle body, and a pair of vertical towers each fixedly attached to a said end of said crossbar and extending both above and below said crossbar.

13. In an apparatus as claimed in claim 12, wherein said crossbar comprises a pair or channel members in web-to-web relationship and spaced to define a slot there between.

14. In an apparatus as claimed in claim 12, wherein each said clamping means is adjustably movable along said crossbar.

15. In an apparatus as claimed in claim 12, and further comprising roller means pivotably connected to each of said towers for supporting said towers upon a supporting surface such that each tower is pivotable in a vertical plane with respect to its respective roller means.

16. In a method of mounting a unibody vehicle structure upon a frame apparatus for straightening and alignment purposes, the steps of raising one end of a vehicle structure, positioning a crossbar having height adjustable roller means on the ends thereof under the raised end and transverse to the longitudinal axis of the vehicle structure, tilting the crossbar with respect to the roller means to an angle corresponding to the angle of inclination of the vehicle structure and securing the cross bar to the underside of the vehicle structure, raising the other end of the vehicle structure, positioning a second crossbar having height adjustable roller means on the ends thereof under the raised other end and transverse to the longitudinal axis of the vehicle structure, tilting the second crossbar with respect to the roller means to an angle corresponding to the angle of inclination of the vehicle structure and securing the second crossbar to the underside of the vehicle structure, raising each secured crossbar to the desired work height of the vehicle structure, and positioning the roller means on said crossbars to support the vehicle structure at the selected work height.

17. In a method as claimed in claim 16, and the step of positioning a bench frame under the secured cross bars and attaching the bench frame to the crossbars.

* * * * *